United States Patent [19]

Harkins

[11] 4,372,075

[45] Feb. 8, 1983

[54] APPARATUS FOR COUPLING AND UNCOUPLING TOY TRACTORS AND SEMITRAILERS

[75] Inventor: Samuel J. Harkins, Maple Shade, N.J.

[73] Assignee: Tyco Industries, Inc., Moorestown, N.J.

[21] Appl. No.: 245,866

[22] Filed: Mar. 20, 1981

[51] Int. Cl.[3] ..... A63H 33/00

[52] U.S. Cl. ..... 46/1 K; 14/71.1

[58] Field of Search ..... 46/202, 219, 257, 1 K, 46/201, 216; 238/10 R, 10 A-10 F; 14/43, 71.1

[56] References Cited

U.S. PATENT DOCUMENTS

| | | | |
|---|---|---|---|
| 3,154,022 | 10/1964 | Lohr et al. | 246/415 A X |
| 3,579,904 | 5/1971 | Genin | 238/10 E |
| 3,693,282 | 9/1972 | Adicks et al. | 46/202 X |
| 4,304,066 | 12/1981 | Brand et al. | 46/202 |

*Primary Examiner*—Mickey Yu

*Attorney, Agent, or Firm*—Seidel, Gonda, Goldhammer & Panitch

[57] ABSTRACT

An improved reciprocating dock for coupling and uncoupling a toy semitrailer and a toy tractor. The dock includes a reciprocable slide and a rotary cam arrangement. During an uncoupling operation, the slide is contacted and displaced by the semitrailer from a fully extended position to a retracted position. During this movement of the slide, the semitrailer travels over a roadway ramp which lifts the semitrailer, uncoupling the semitrailer from the tractor. A spring returns the slide from the fully retracted position to a partially extended position, and the rotary cam arrangement arrests the slide at the partially extended position. During movement of the slide to the partially extended position, the slide moves the semitrailer to a prescribed position such that the semitrailer remains elevated with respect to the tractor and poised for a re-coupling operation. To re-couple the semitrailer and tractor, the semitrailer displaces the slide from the partially extended position to the fully retracted position, and the spring then returns the slide from the fully retracted position, past the partially extended position, to the fully extended position. During this movement of the slide, the semitrailer moves past the ramp which causes the semitrailer to descend and reengage the tractor.

10 Claims, 15 Drawing Figures

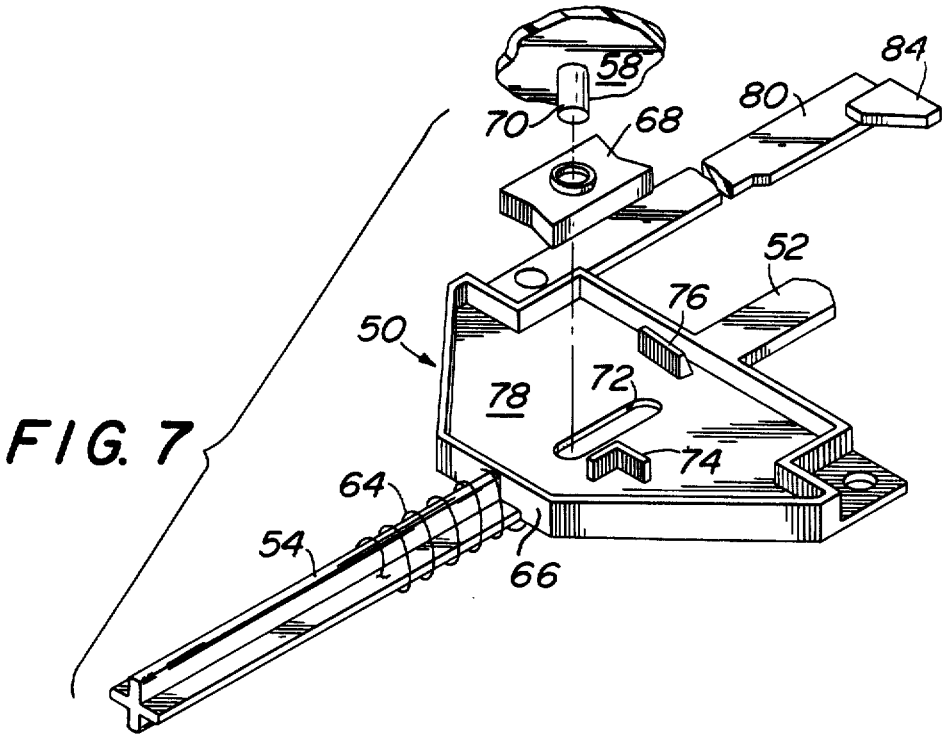
FIG. 7
FIG. 8
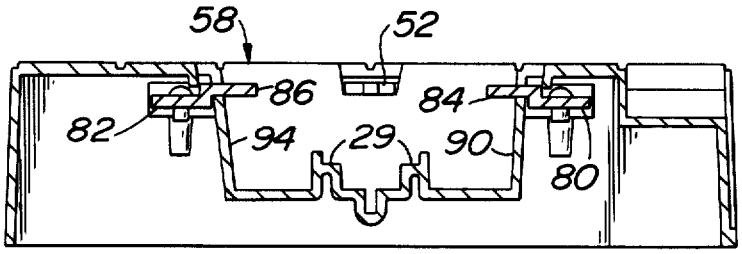

APPARATUS FOR COUPLING AND UNCOUPLING TOY TRACTORS AND SEMITRAILERS

BACKGROUND OF THE INVENTION

This invention relates to toy tractor and semitrailer trucks. In particular, the invention is directed to an improved reciprocating dock for reliably and automatically coupling and uncoupling the semitrailer and the tractor based on reversal of movement of the tractor.

Automatic uncoupling of a toy semitrailer from a toy tractor truck has been proposed in co-pending application Ser. No. 40,860 titled APPARATUS FOR COUPLING AND UNCOUPLING TOY TRUCK TRACTORS AND SEMITRAILERS in the names of D. A. Brand and D. R. Brand wherein a ramp is disposed in a roadway inboard of the tractor wheels. The semitrailer dolly wheels travel up the ramp during the uncoupling operation to pivot the semitrailer upwardly with respect to the tractor. As the semitrailer is pivoted, it releases the tractor.

Automatic coupling of the toy semitrailer to the toy tractor has also been proposed in application Ser. No. 40,860. A simple beveled end is provided on the rear platform of the toy tractor for this purpose. As the tractor backs up to the semitrailer, a king pin on the semitrailer rides up the bevel to the flat area of the rear platform of the tractor and drops into a pivot hole to engage the tractor.

Both the uncoupling and coupling operations are carried out in the same locality and are assisted by a reciprocating dock comprising a bellows. During an uncoupling operation, the dock is contacted and moved backward by the semitrailer as the semitrailer dolly wheels ride up the ramp to release the tractor. As the dock is moved backward, the bellows is compressed. When the direction of movement of the uncoupled tractor is reversed to cause the tractor to depart, the dock and semitrailer are released. The bellows expands to move the dock and semitrailer forwardly so that the semitrailer dolly wheels ride off the ramp and onto the roadway. In this position, the semitrailer is not poised for re-coupling to the tractor. The tractor must subsequently be backed up into the semitrailer and the semitrailer king pin must be moved back up the tractor bevel to re-connect the two vehicles.

Re-connecting the tractor and semitrailer in this fashion may pose a frustrating problem to a child. If the tractor is not stopped quickly after re-connection to the semitrailer, the semitrailer may be moved backwardly such that the dolly wheels travel back up the ramp thereby inadvertently disconnecting the tractor and semitrailer. The child may not possess the eye-hand motor coordination required to stop the tractor quickly after re-connection to the semitrailer to prevent disconnection of the vehicle. Accordingly, a certain degree of unwanted skill is necessary to reliably operate the apparatus described in the aforementioned patent application.

SUMMARY OF THE INVENTION

The improved reciprocating dock provides a return stroke which depends on the initial dock position at the time the tractor backs into the semitrailer. The initial dock position corresponds in a predetermined manner to the initial position of the semitrailer dolly wheels. At the start of an uncoupling operation, the dock is fully extended. At the start of a coupling operation, the dock is only partially extended. Uncoupling the semitrailer and tractor is achieved by backing the semitrailer dolly wheels up the inclined portion of the ramp onto the flat portion of the ramp, thereby pivoting the front of the semitrailer upwardly so that the semitrailer pivot pin is lifted out of the pivot hole in the rear platform of the tractor. The tractor continues to back up against the semitrailer until the dock reaches the limit of its backward stroke at which point a cam is operated. The tractor is then caused to reverse direction and move forwardly by remote control. A spring action slowly moves the dock and the semitrailer forward until the dolly wheels reach a prescribed position on the flat of the ramp at which point the cam is operated to arrest further forward movement of the dock and semitrailer. The dock is held in the partially extended position. At this position, the semitrailer remains pivoted upwardly such that its pivot pin cannot enter the rear platform of the tractor. The semitrailer is poised for re-coupling to the tractor.

When it is desired to reconnect the tractor and semitrailer, the tractor backs into the semitrailer and moves the semitrailer and dock back until the dock reaches the limit of its backward stroke. The semitrailer dolly wheels remain on the flat of the ramp so that the semitrailer remains poised for re-coupling to the tractor. When the dock reaches the limit position, the cam is operated to release the dock for forward movement. The truck tractor is then caused to reverse direction and move forwardly by remote control. The spring action moves the dock and semitrailer forward so that the semitrailer dolly wheels ride down the ramp incline to the roadway. As the dolly wheels ride down the incline, the semitrailer pivots downwardly and the semitrailer pivot pin enters the hole in the rear platform of the tractor, coupling the semitrailer and tractor. The dock moves to the fully extended position and the cam is restored to its initial operating position to accomodate a new coupling operation.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 3A–6A are sections taken along the lines A—A in FIG. 2 for four positions of the cam.

FIGS. 3B–6B are sections taken along the lines 2—2 in FIG. 1 for the four cam positions.

FIG. 7 is an exploded view of the spring and cam mechanism.

FIG. 8 is a section taken along the lines 8—8 in FIG. 1.

DETAILED DESCRIPTION OF THE INVENTION

Figure 9:
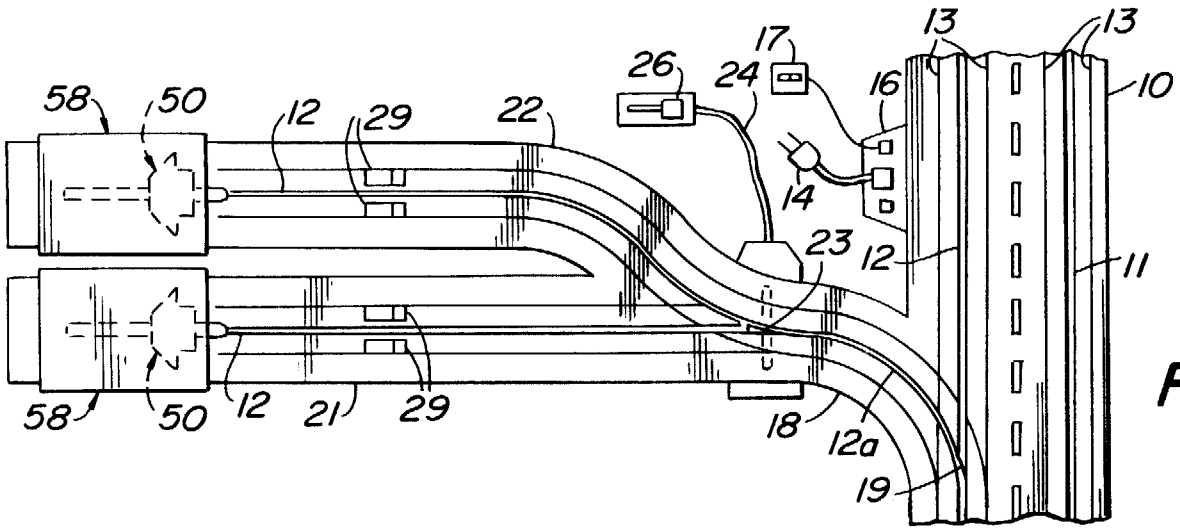
FIG. 9 is a plan view of a portion of a two-way slot roadway having a branch which in turn is divided into two roadways leading to reciprocating docks.

Referring to FIG. 9, there is illustrated a two-way slot roadway 10 having a guide slot 11 for traffic in one direction and a guide slot 12 for traffic in another direction. Each half of the roadway is energized by conductors 13 projecting upwardly from the roadway surface to be contacted by spring conductors attached to the bottom of the tractor vehicles, as is well known in the industry. The conductors 13 are energized by electrical current in the apparatus 16. The amount of voltage and the direction of current flow in the conductors may be controlled by the manual controller 17. Projecting from the roadway 10 is a branch roadway 18. No switch is required for the guide 12*a* of this branch because traffic is normally downward in the lefthand track 12. Backing the tractor vehicle into the branch 18 is effected by a resilient spring 19, which allows passage downwardly as viewed in FIG. 9, but intercepts guides on tractor vehicles moving upwardly (in reverse) in FIG. 9.

The branch 18 may, if desired, be divided into two tracks 21 and 22. For this switching operation, a triangular frog 23 is provided under the control of a Bowden wire 24 and a manual slide button 26.

Disposed at the left end of each branch 21 and 22 is a reciprocating dock 58 provided particularly in accordance with the invention. To the right of the loading docks 58 in each branch is a pair of ramps 29.

Referring now to FIGS. 3B–6B, disposed on the roadway 21 is a semitrailer 31 having rear wheels 32, which are preferably spaced outwardly from the conductors 13 on the roadway 21. While a single pair of wheels 32 could be provided, one on each side of the semitrailer 31, there is illustrated two pairs of wheels 32 mounted on a rotatable truck or carriage 33 having a pivot at 34. The pivoted truck or carriage 33 reduces friction loads while the vehicle is being pulled around curves. To make the carriage 33 track properly there are two guide stems 36, one forward of the pivot and one rearward of the pivot, both having their bottom ends fitting into the groove 12. This type of dual guidance gives great freedom from friction at the turns when the semitrailer 31 is being towed.

At the forward end of the semitrailer 31, to the right in FIGS. 3B–6B, a pair of downwardly projecting struts 37 secured to the semitrailer 31 support a pair of dolly wheels 38. These dolly wheels preferably just clear the roadway 21 when the semitrailer is being towed. Also referring to the righthand or front end of the semitrailer 31, there is a downwardly projecting king pin 39, which fits into a pin recess 41 on a rear pivot platform 42 of a tractor 43. The tractor 43 may have three pairs of wheels 44 to simulate heavy-duty trucks, and any one pair of these wheels may be driven by an electric motor (not shown) mounted in the tractor 43. The electric motor derives its current from the conductors 13, as is well known in the industry. The spacing of the tractor wheels is preferably the same as that of the spacing of the wheels of the semitrailer, that is, outwardly from the electrical conductors 13. The tractor 43 may also be provided with a pair of forward and rearward guide pins 45 to eliminate the necessity for steering mechanisms on the tractor.

Heretofore, the rear edge of the tractor 43 was provided with a beveled surface 46 as shown in the drawings and as described in co-pending application 40,860. The lower edge of the beveled surface was disposed below the lowermost point of the king pin 39 when the dolly wheels 38 rested on the roadway 21. This beveled surface 46 enabled the coupling of the tractor 43 to the semitrailer 31. The beveled surface is made unnecessary by the present invention and may be dispensed with as explained more fully hereafter.

The structure of the loading dock 58 is best illustrated by comparing FIGS. 1, 2, 7, 8 and 10. The dock 58 includes a reciprocable slide member 50 having a tongue 52 and a ribbed extension 54. The extension 54 is maintained in lateral alignment by a pair of supporting fingers 56 which depend from the platform of dock 58. The tongue 52 extends through a slot 60 in dock wall 62. A compression spring 64 is disposed around extension 54 between rear wall 66 of slide 50 and the supporting fingers 56. Preferably, the spring 64 is relatively soft having a rate of approximately 36 grams per inch.

A cam 68 is rotatably positioned about a pin 70 which depends from the platform 58. The pin 70 is located in a slot 72 in the slide floor 78. The slot permits reciprocable movement of the slide 50 with respect to the cam 68. A pair of fixed stops 74, 76 are provided on the slide floor 78 to operate the cam during coupling and uncoupling operations. Stop 76 is canted approximately 3 degrees away from the vertical plane.

If desired, arms 80, 82 may be mounted on either side of the slide 50 to prevent jack-knifing of the tractor and semitrailer during a coupling operation as described more fully hereafter. The arms extend forwardly of the dock, to the right in FIG. 1, and terminate in tabs 84 and 86 respectively. Tab 84 protrudes through slot 88 in dock wall 90, and tab 86 protrudes through slot 92 in dock wall 94. Tabs 84 and 86 are contacted by lugs 96, 98 respectively which are mounted on opposite sides of tractor 43 (FIG. 3A).

Figure 1:
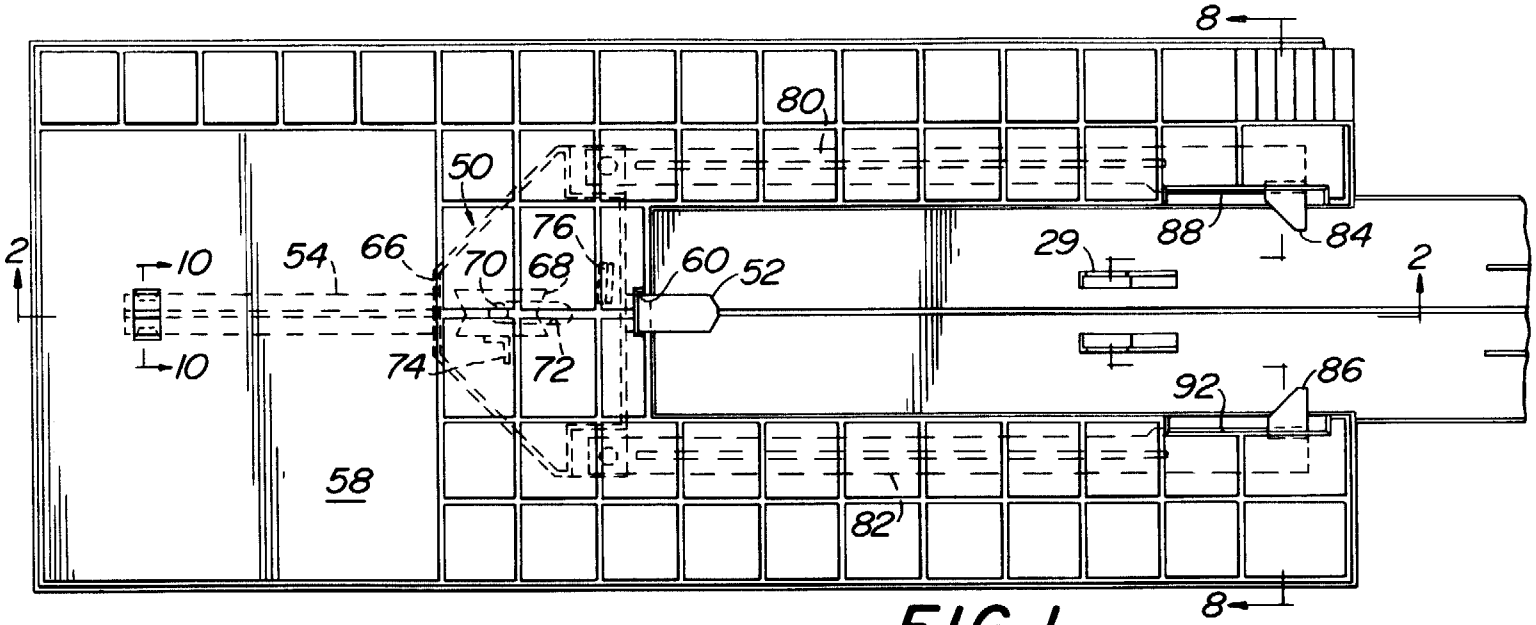
FIG. 1 is a plan view of the improved reciprocating dock of the present invention.
Figure 2:
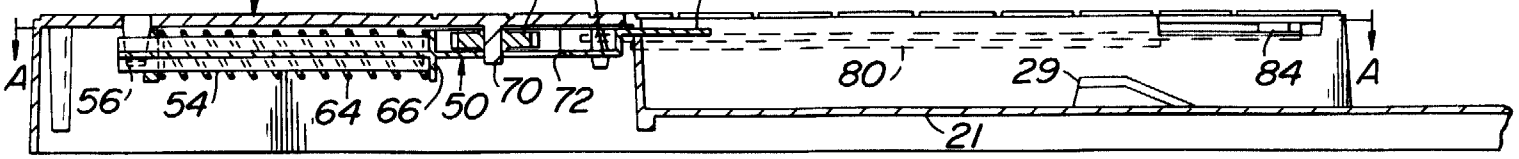
FIG. 2 is a cross-section of the dock taken along the lines 2—2 in FIG. 1.
Figure 3A:
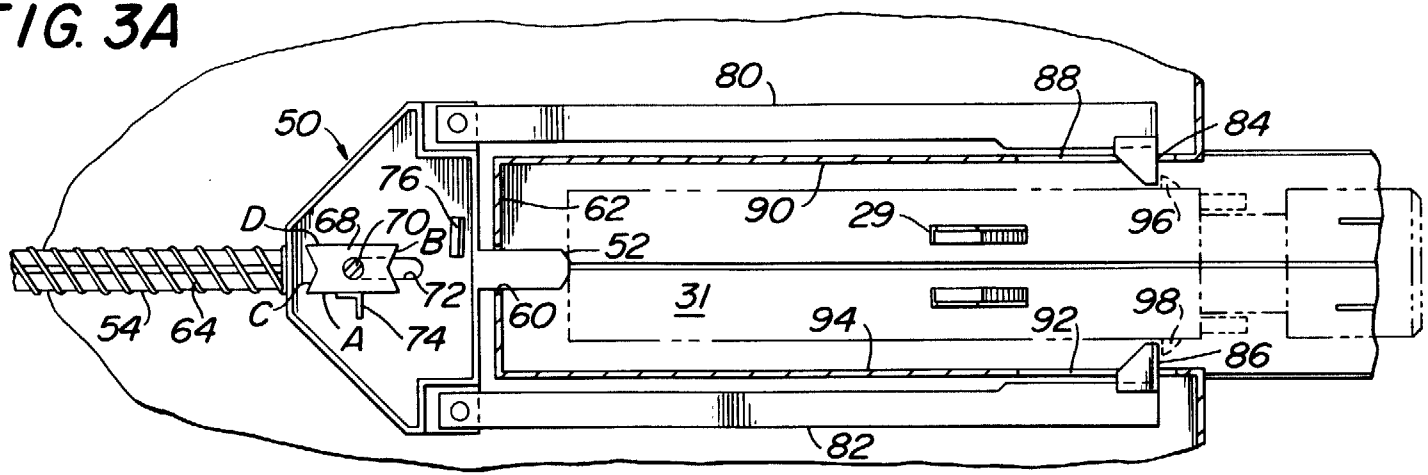
Figure 3B:
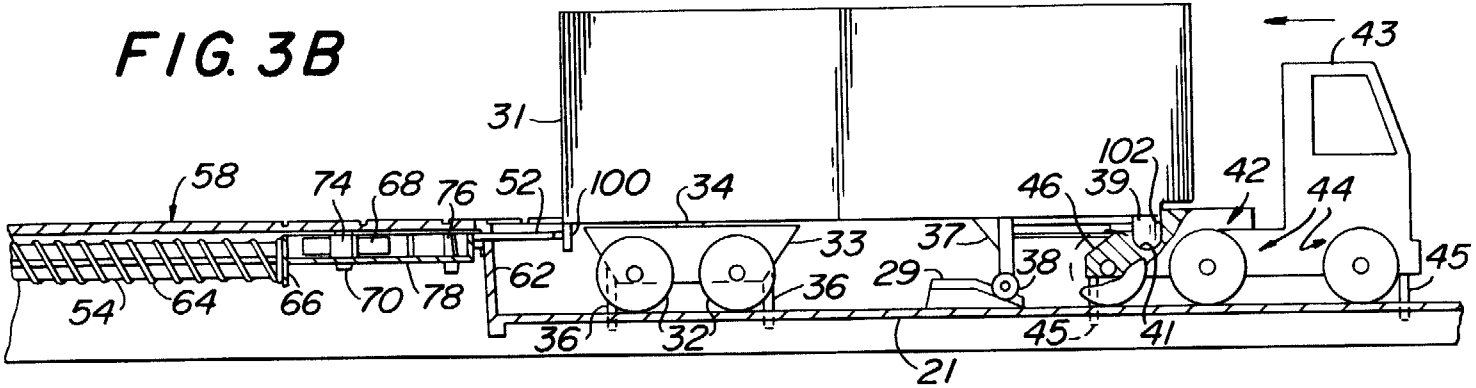

Referring now to FIGS. 3B and 9, the tractor 43, when coupled to the semitrailer 31, proceeds downwardly on the lefthand part of the roadway 10. The guide pins 45 on the tractor 43 push aside the flexible finger 19 in the track 12, and likewise the guide pins 36 at the rear of the semitrailer 31 push aside the flexible finger. When the entire tractor and semitrailer are past the flexible finger 19, the operator operates the control 17 to stop the vehicle and then reverses the polarity of the current in the conductors 13, whereupon the semitrailer and tractor back up and their guide pins are then intercepted by the flexible finger 19 to direct both parts of the vehicle to the branch roadway 18. The frog 23 is then actuated by the mechanical switching device 26 to direct the guide pins into track 21 or track 22, the operations of which are identical.

Referring to FIGS. 3A and 3B, the side wall A of cam 68 is aligned initially against stop 74 (FIG. 3A) when the semitrailer dolly wheels contact the ramp incline and the semitrailer first contacts tongue 52 (FIG. 3B). As the tractor 43 with its attached semitrailer 31 backs up, that is, to the left in FIG. 3B, the back tab 100 of the semitrailer strikes the tongue 52 which causes the slide 50 to move to the left, compressing the spring 64. As the spring is compressed, the dolly wheels 38 ride up the incline of ramp 29 and onto the flat of the ramp thereby elevating the front of the semitrailer 31 as shown in FIG. 4B. The tractor rear platform shoulder 102 (FIG. 3B) contacts the semitrailer king pin 39, urging the semitrailer back against the tongue 52 so that the slide continues to move backward against spring 64.

Figure 4A:
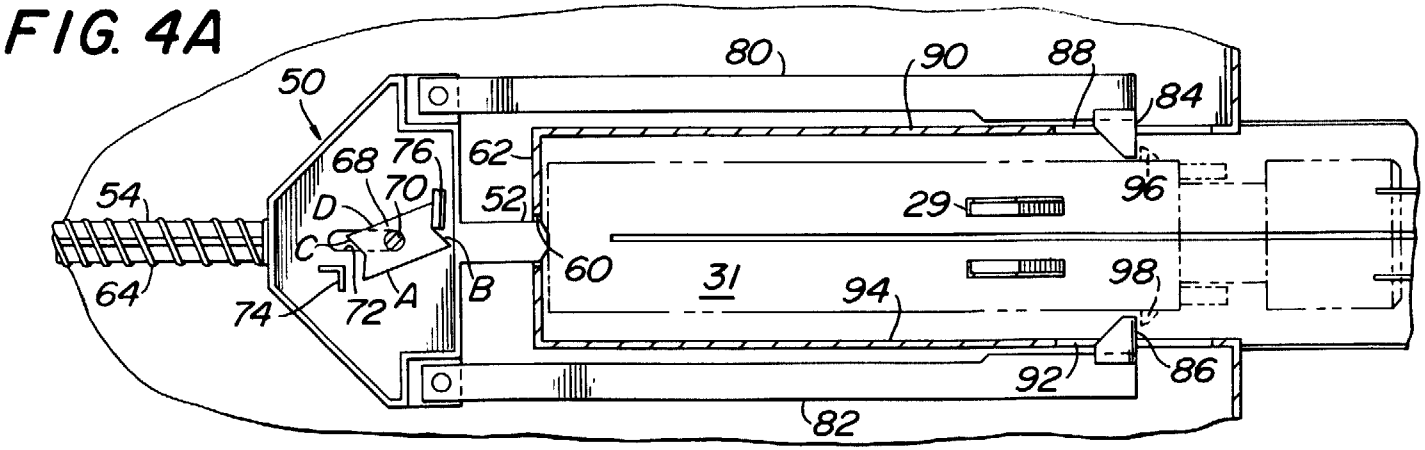
Figure 4B:
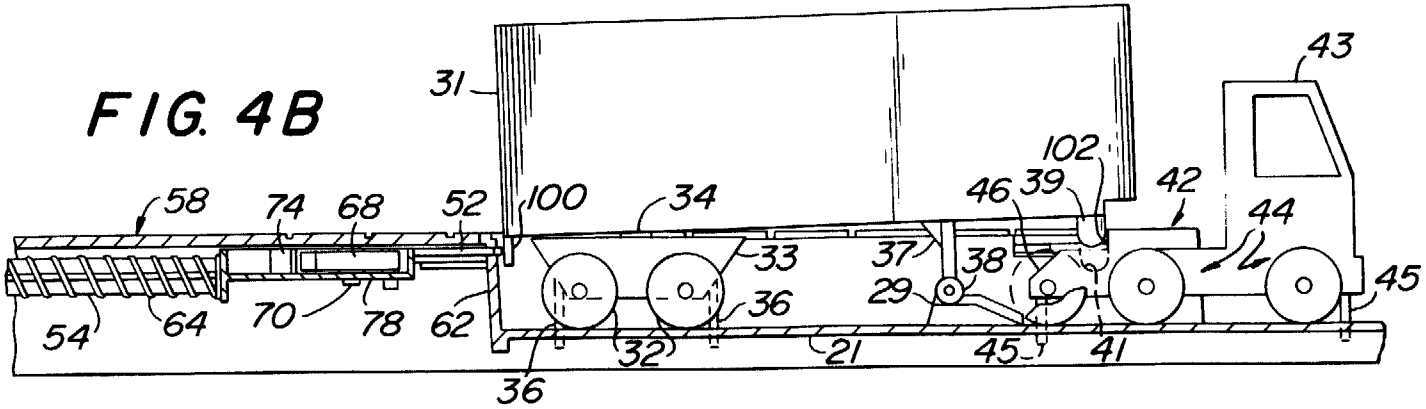

The slide 50 reaches a leftmost limit position when the end B of cam 68 contacts stop 76 and is rotated into alignment with the stop as shown in FIG. 4A. The operator observes that no further backward motion of the semitrailer is possible and reverses the current through control 17 to cause the tractor vehicle 43 to move to the right, freeing the slide and the semitrailer in the position shown in FIG. 4B.

Figure 5A:
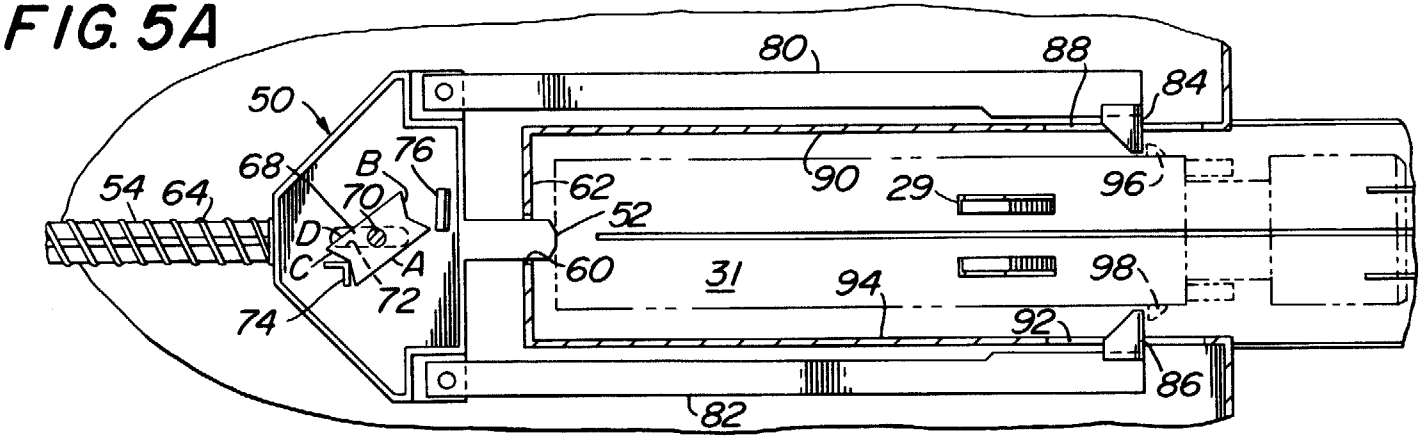
Figure 5B:
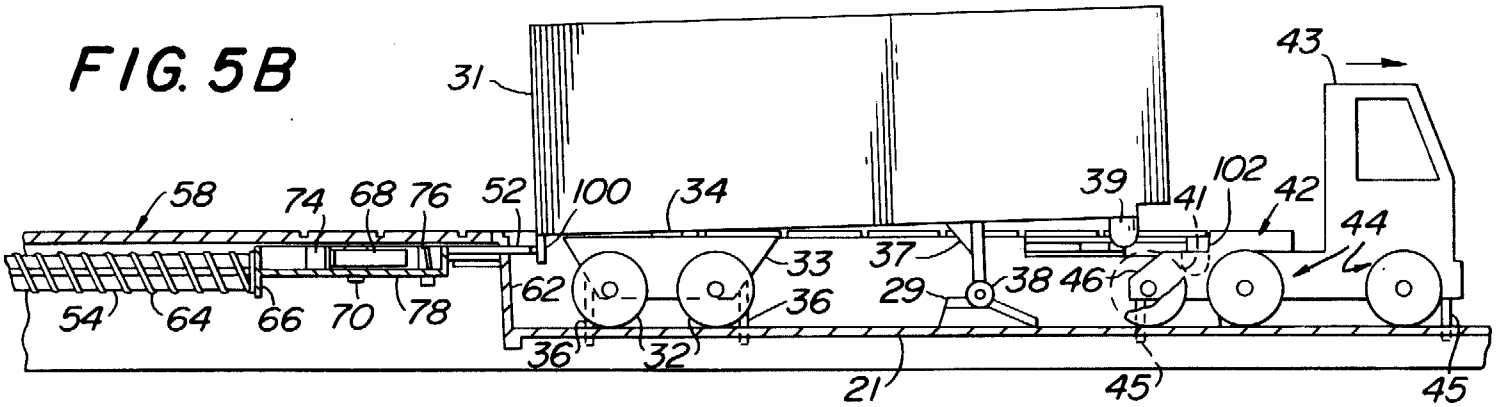

As the tractor 43 moves to the right, the compression spring 64 expands. The slide 50 will therefore move to the right, gently pushing the semitrailer 31 to the right until the semitrailer 31 reaches the position shown in FIG. 5B wherein the dolly wheels rest at a prescribed position nearer the forward edge of the flat of the ramp 29. The slide 50 is arrested at this point by stop 74 which contacts the end C of cam 68 and rotates the cam to the position as shown in FIG. 5A. Accordingly, the semitrailer dolly wheels are prevented from reaching the ramp incline and the semitrailer is maintained in the elevated position shown in FIG. 5B as the tractor 43 is moved away from the dock. In this position, the slide is partially extended and the semitrailer is poised for subsequent coupling to the tractor at a time desired by the operator.

To re-couple the tractor and semitrailer, the operator manipulates control 17 to cause the tractor 43 to back up toward the semitrailer. As indicated previously, the platform 42 of the tractor had heretofore been provided with a beveled edge 46. The beveled edge 46 was required to effect a coupling operation by pivoting the semitrailer upwardly during backward movement of the tractor as described in co-pending application Ser. No. 40,860. In the present invention, the beveled edge is unnecessary and may be dispensed with. Thus, the beveled edge cannot strike the pin 39 when the semitrailer is poised for coupling and the dolly wheels of the semitrailer rest on the flat of ramp 29 since the pin 39 is elevated above the pin recess 41.

Figure 6A:
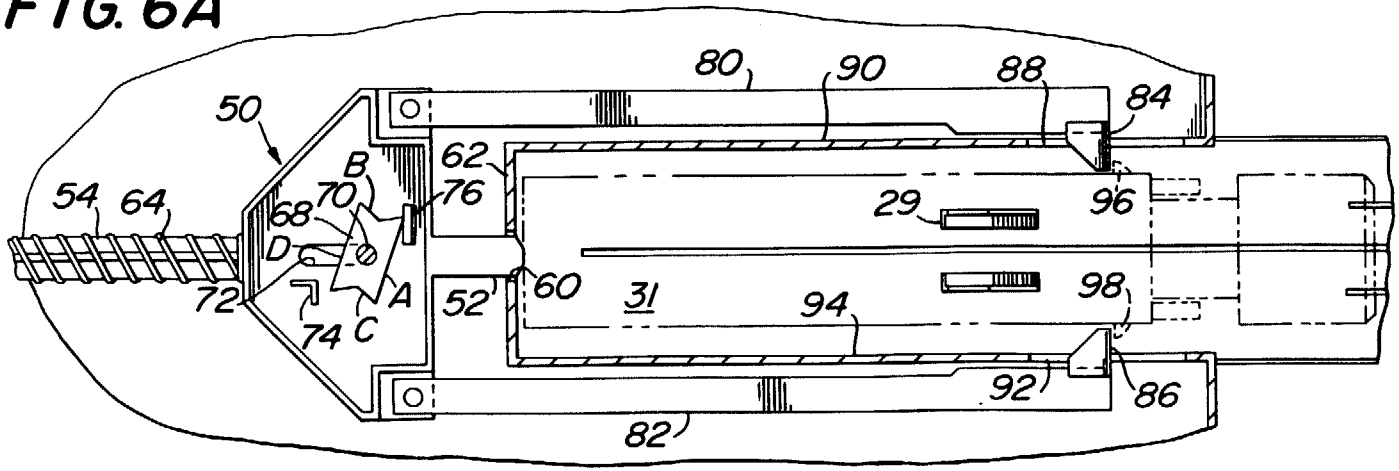
Figure 6B:
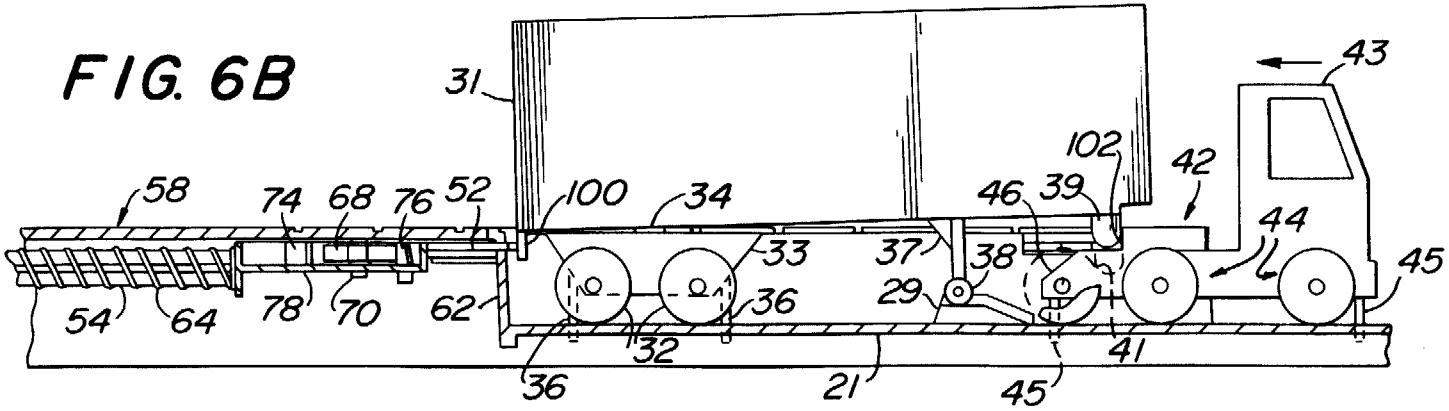

In the present invention, as tractor 43 moves backwards, to the left in FIG. 6B, the shoulder 102 of tractor platform 42 contacts pin 39 and pushes the semitrailer backwards against slide 50 until the slide again reaches the leftmost limit position. Further backward movement of the slide is prevented by the end of the slot in slide 50 contacting pin 70 as side A of cam 68 strikes cam actuating surface 76 and rotates the cam to the position shown in FIG. 6A. Again, the operator observes that no further backward motion of the semitrailer is possible and reverses the current through control 17 to cause the tractor 43 to move to the right. As the tractor moves to the right, spring 64 expands, and slide 50 gently pushes the semitrailer 31 forward, i.e., in the same direction of travel as the tractor 43. The semitrailer dolly wheels 38 therefore traverse the flat of the ramp 29 and ride onto the inclined portion of the ramp with the pin 39 poised over recess 41 in the tractor platform. As the dolly wheels descend the ramp incline, the semitrailer pivots downwardly and pin 39 approaches and drops into recess 41. At the same time, the forward motion of slide 50 causes stop 74 to push against side D of cam 68 and rotate the cam back to the initial position shown in FIG. 3A, with side D now aligned with the stop 74 instead of side A. At this point, the slide is fully extended, the dolly wheels 38 are off the ramp incline, and the semitrailer 31 is coupled to the tractor 43.

In the semitrailer and reciprocating dock arrangement proposed in co-pending application Ser. No. 40,860 a bellows is employed to move the dock and semitrailer forwardly after an uncoupling operation. The forward (return) stroke of the bellows never varies. The bellows always returns the dock to the fully extended position so that the semitrailer dolly wheels 38 travel over the ramp incline and return to the roadway 21. As previously indicated, to re-couple the tractor and semitrailer using the arrangement proposed in application 40,806, the tractor must be backed up toward the semitrailer so that the beveled edge 46 at the rear of the tractor strikes the pin 39, causing a camming action which lifts the front end of the semitrailer. The pin 39 rides on the tractor platform 42 until it reaches the pin recess 41, whereupon the pin drops by gravity into the recess.

This arrangement, however, poses a significant problem to the child having limited motor skills. Thus, should the backward movement of the tractor be permitted to continue after the pin 39 seats in recess 41, the dolly wheels may be inadvertently forced back up the ramp incline. As a result, the front end of the semitractor may pivot upwardly and the pin 39 may disengage from the recess 41 as in a normal uncoupling operation. Thus, if the tractor 43 is not stopped quickly by the child once the tractor and semitrailer have been re-coupled, an unwanted uncoupling operation may result. This possibility is avoided by the present invention by limiting the forward movement of the semitrailer after an uncoupling operation such that the semitrailer dolly wheels remain on the flat of the ramp 29 so that the semitrailer is left poised on the ramp for a re-coupling operation. Thereafter a re-coupling operation is effected while the semitrailer and tractor travel in the same direction, away from the dock, and the semitrailer dolly wheels descend on the ramp incline. No inadvertent uncoupling of the tractor and semitrailer is possible.

As previously indicated, the slide 50 may be provided with arms 80 and 82 to prevent jack-knifing of the semitrailer and tractor. This condition may otherwise result when the tractor is backed up at high speed during a re-coupling operation. The tractor platform shoulder 102 may strike the semitrailer pin 39 with enough force to lift the semitrailer over the shoulder, preventing engagement of pin 39 and recess 41. To prevent this, the lengths of arms 80 and 82 are chosen to enable the tractor tabs 96, 98 (FIG. 3A) to contact the arm tabs 84 and 86 before rear semitrailer tab 100 strikes the tongue 52. As a result, the tractor rather than the semitrailer pushes slide 50 when the tractor shoulder 102 first contacts pin 39, and a small gap is created between the rear of the semitrailer and the tongue. The semitrailer may therefore travel backward within the gap, towards dock 58, without being lifted over should 102 when the pin 39 is first struck by the shoulder.

Figure 11:
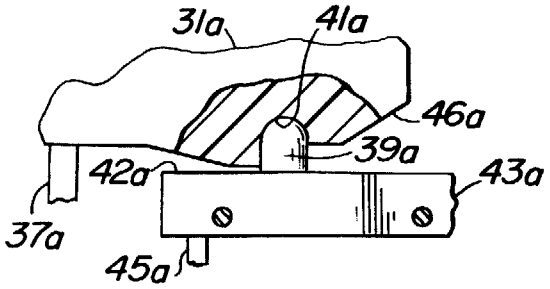
FIG. 11 is a fragmentary elevation of a modified form of the semitrailer and tractor coupling mechanism wherein the king pin projects from the tractor into a recess in the trailer.
Figure 10:
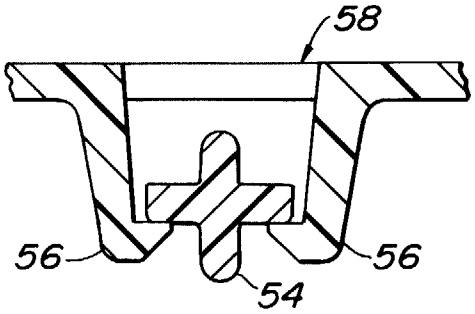
FIG. 10 is a partial section taken along the lines 10—10 in FIG. 1.

It should be appreciated that other coupling mechanisms for the semitrailer and tractor may be employed in connection with the improved reciprocating dock described herein, within the spirit and scope of the invention. For example, referring now to FIG. 11, there is illustrated a modification of the coupling mechanism as proposed in co-pending application Ser. No. 40,860 wherein a tractor truck **43*a* has a pivot platform 42*a*, provided with an upwardly projecting pin 39*a*. The pin 39*a* fits into a recess 41*a* in a semitrailer 31*a*. The pivot pin recess 41*a* is forward of a dolly wheel strut 37*a*, and the rear of the tractor 43*a* may be guided by a pin 45*a*. As disclosed in co-pending application Ser. No. 40,860, the forward edge of the semitrailer 31*a* is beveled at 46*a*** to provide for a coupling of the two vehicles although it should be appreciated that the bevel 46a may be dispensed with in connection with the present invention since the coupling operation is always performed when the semitrailer is already poised for coupling on the flat of ramp 29.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for coupling a toy semitrailer and a toy tractor which ride on a roadway, wherein the semitrailer is provided with dolly wheels and a depending pin forward of the dolly wheels and the tractor is provided with a recess within which the semitrailer pin can be seated, comprising:

(a) a ramp in said roadway having an inclined portion and a flat portion;

(b) reciprocable means adapted for a movement between a fully retracted position with respect to the ramp and a fully extended position with respect to the ramp, said fully extended position being located between said fully retracted position and said ramp;

(c) means for automatically presetting and releasably retaining said reciprocable means in a partially extended position intermediate the fully retracted and fully extended positions such that the semitrailer dolly wheels rest on the flat portion of the ramp and the semitrailer pin is elevated with respect to the tractor recess;

(d) said reciprocable means being adapted to be contacted and displaced by said semitrailer from said partially extended position to said fully retracted position such that the dolly wheels remain on the flat portion of the ramp;

(e) means for urging said reciprocable means from said fully retracted position past said partially extended position to said fully extended position to cause said reciprocable means to contact the semitrailer and move the semitrailer such that the dolly wheels ride off the flat portion of the ramp onto the inclined portion of the ramp whereby the forward end of the semitrailer pivots downwardly and the semitrailer pin enters the tractor recess.

2. Apparatus according to claim 1 wherein said reciprocable means includes a reciprocable slide provided with spaced stops and wherein said means for automatically presetting and releasably retaining the reciprocable means includes a rotary cam adapted and arranged to be alternately contacted by said stops as said slide reciprocates between said fully retracted and fully extended positions.

3. Apparatus according to claim 2 wherein said means for urging said reciprocable means includes a spring arranged in yielding contact with said slide.

4. Apparatus for coupling a toy semitrailer and a toy tractor which ride on a roadway, the semitrailer being provided with dolly wheels and a depending pin forward of the dolly wheels and the tractor being provided with a recess within which the semitrailer pin can be seated, comprising:

(a) a ramp in said roadway having an inclined portion and a flat portion;

(b) a reciprocable slide provided with a plurality of spaced stops, said slide being adapted for movement between a fully retracted position with respect to the ramp and a fully extended position with respect to the ramp, said fully extended position being located between said fully retracted position and said ramp;

(c) a rotary cam arranged to be contacted and rotated by at least one of said stops as said slide moves away from said fully retracted position to releasably retain said slide in a partially extended position intermediate the fully extended and fully retracted positions such that the semitrailer dolly wheels rest on the flat portion of the ramp and the semitrailer pin is elevated with respect to the tractor recess;

(d) said reciprocable slide being adapted to be contacted and displaced from said partially extended position to said fully retracted position;

(e) a spring arranged in yielding contact with said slide for urging said slide from said fully retracted position past said partially extended position to cause the slide to contact the semitrailer and move the semitrailer such that the semitrailer dolly wheels ride off the flat portion of the ramp onto the inclined portion whereby the forward end of the semitrailer pivots downwardly and the semitrailer pin enters the tractor recess.

5. Apparatus for uncoupling a toy semitrailer and a toy tractor which ride on a roadway, wherein the semitrailer is provided with dolly wheels and a depending pin forward of the dolly wheels and wherein the tractor is provided with a recess within which the semitrailer pin can be seated, comprising:

(a) a ramp in said roadway having an inclined portion and a flat portion;

(b) reciprocable means adapted for movement between a fully retracted position with respect to the ramp and a fully extended position with respect to the ramp, said fully extended position being located between said fully retracted position and said ramp;

(c) said reciprocable means being adapted to be contacted and displaced from said fully extended position to said fully retracted position by said semitrailer whereby the dolly wheels ride up the inclined portion of the ramp onto the flat portion of the ramp thereby elevating the semitrailer pin with respect to the tractor recess to uncouple the semitrailer and the tractor and allowing the tractor to move freely away from the semitrailer;

(d) means for urging said reciprocable means from said fully retracted position towards a partially extended position intermediate said fully extended and fully retracted positions;

(e) means for releasably retaining said reciprocable means in said partially extended position such that the semitrailer dolly wheels rest on the flat portion of the ramp, whereby the semitrailer pin is elevated with respect to the tractor recess and the pin is disengaged from the recess.

6. Apparatus according to claim 5 wherein said reciprocable means includes a reciprocable slide provided with spaced stops and wherein said means for releasably retaining said reciprocable means includes a rotary cam adapted and arranged to be alternately contacted by said stops as said slide reciprocates.

7. Apparatus according to claim 6 wherein said means for urging said reciprocable means includes a spring arranged in yielding contact with said slide.

8. Apparatus for uncoupling a toy semitrailer and a toy tractor which ride on a roadway, wherein the semitrailer is provided with dolly wheels and a depending pin forward of the dolly wheels and wherein the tractor is provided with a recess within which the semitrailer pin can be seated, comprising:

(a) a ramp in said roadway having an inclined portion and a flat portion;

(b) a reciprocable slide provided with a plurality of spaced stops;

(c) said reciprocable slide being adapted to be contacted and displaced by the semitrailer from a fully extended position with respect to the ramp to a fully retracted position with respect to the ramp, said fully extended position being located between said fully retracted position and said ramp, whereby the dolly wheels ride up the inclined portion of the ramp thereby elevating the semitrailer pin with respect to the tractor recess to uncouple the semitrailer and the tractor and allowing the tractor to move freely away from the semitrailer;

(d) a spring arranged in yielding contact with said slide for urging said slide from said fully retracted position towards said fully extended position;

(e) a rotary cam arranged to be contacted by a first stop and rotated to a position against a second stop to releasably retain said slide at a partially extended position intermediate said fully extended and fully retracted positions such that the semitrailer dolly wheels rest on the flat portion of the ramp and the semitrailer pin is elevated with respect to the recess whereby the pin is disengaged from the recess and the semitrailer is poised for coupling to the tractor.

9. Apparatus for uncoupling a toy semitrailer and a toy tractor which ride on a roadway, wherein the semitrailer is provided with dolly wheels and a depending pin forward of the dolly wheels and wherein the tractor is provided with a recess within which the semitrailer pin can be seated, comprising:

(a) a ramp in said roadway having an inclined portion and a flat portion;

(b) reciprocable means adapted for movement between a fully retracted position with respect to the ramp and a fully extended position with respect to the ramp, the fully extended position being located between the fully retracted position and the ramp;

(c) said reciprocable means having a plurality of spaced stops being adapted to be contacted and displaced from said fully extended position to said fully retracted position by said semitrailer such that the dolly wheels ride up the inclined portion of the ramp onto the flat portion of the ramp thereby elevating the semitrailer pin with respect to the tractor recess to uncouple the semitrailer and the tractor and allowing the tractor to move freely away from the semitrailer;

(d) a multiple position cam arranged to be contacted by a first stop when said reciprocable means moves from said fully extended position to said fully retracted position; and (e) said multiple position cam being arranged to be contacted by a second stop when said reciprocable means moves from said fully retracted position to a partially extended position intermediate said fully extended and fully retracted positions and thereby releasably retain said reciprocable means in said partially extended position such that the semitrailer dolly wheels rest on the flat portion of the ramp whereby the semitrailer pin is maintained in an elevated position with respect to the tractor recess.

10. Apparatus for coupling a toy semitrailer and a toy tractor which ride on a roadway, wherein the semitrailer is proded with dolly wheels and a depending pin forward of the dolly wheels and wherein the tractor is provided with a recess within which the semitrailer pin can be seated, comprising:

(a) a ramp in said roadway having an inclined portion and a flat portion;

(b) reciprocable means adapted for movement between a fully retracted position with respect to the ramp and a fully extended position with respect to the ramp, said fully extended position being located between said fully retracted position and said ramp, said reciprocable means including a slide provided with a plurality of spaced stops;

(c) a multiple position cam arranged to be contacted by a first stop to releasably retain said slide in a partially extended position intermediate said fully extended and fully retracted positions such that the dolly wheels rest on the flat portion of the ramp;

(d) said reciprocable means being adapted to be contacted and displaced from said partially extended position towards said fully retracted position by said semitrailer;

(e) said cam being arranged to be contacted by a second stop when said reciprocable means moves toward said fully retracted position and to be advanced by said second stop to release said reciprocable means from retention at said partially extended position for movement from said fully retracted position past said partially extended position to said fully extended position such that the reciprocable means contacts the semitrailer and moves the semitrailer whereby the dolly wheels ride off the flat portion of the ramp onto the inclined portion of the ramp so that the forward end of the semitrailer pivots downwardly and the semitrailer pin enters the tractor recess.

* * * * *